US006827225B2

(12) United States Patent
Miilu et al.

(10) Patent No.: US 6,827,225 B2
(45) Date of Patent: Dec. 7, 2004

(54) DISHWASHER RACK CLIP

(75) Inventors: John H. Miilu, Jackson, TN (US); Christopher W. Vaughn, Jackson, TN (US); Thomas M. Johnson, Jackson, TN (US); Karl R. C. Wendt, Jackson, TN (US); Barry E. Tuller, Humboldt, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/310,337

(22) Filed: Dec. 5, 2002

(65) Prior Publication Data

US 2004/0108283 A1 Jun. 10, 2004

(51) Int. Cl.[7] ..... A47F 5/00
(52) U.S. Cl. ..... 211/41.9; 211/183
(58) Field of Search ..... 211/183, 41.9, 211/41.8

(56) References Cited

U.S. PATENT DOCUMENTS 3,289,854 A 12/1966 Kauffman
3,451,556 A 6/1969 Macoicz
3,451,557 A 6/1969 Stoddard
4,917,248 A 4/1990 Friskney
4,927,033 A 5/1990 Patera et al.
5,249,590 A 10/1993 Jacobus et al.
5,405,018 A * 4/1995 Anthrop ..... 211/41.9 X
5,580,025 A 12/1996 Cross
5,918,749 A 7/1999 Pille et al.
6,123,204 A 9/2000 Nelson et al.
6,364,131 B1 4/2002 Moylan
6,394,285 B1 * 5/2002 Arthurs ..... 211/41.9
6,557,567 B2 * 5/2003 Mood ..... 211/41.8 X

* cited by examiner

*Primary Examiner*—Robert W. Gibson, Jr.
(74) *Attorney, Agent, or Firm*—McKee, Voorhees, Sease, P.L.C.

(57) ABSTRACT

A clip is provided for mounting in a dishwasher rack to hold objects to be washed. The clip includes a base having opposite ends with an opening adjacent each end so that the clip can be mounted on at least a pair of rack tines. At least one resilient tab extends upwardly from the base and is adapted to retain a cup or other object in the rack. Mounting the clip on at least a pair of tines provides strength and stability for the clip.

29 Claims, 10 Drawing Sheets

DISHWASHER RACK CLIP

BACKGROUND OF THE INVENTION

Various types of clips and article retainers are well known for use in dishwasher racks to hold objects to be washed. Such clips and retainers typically mount onto one of the wire members on the bottom or sides of the rack, or on one of the upstanding tines in the rack. The tine mounted clips have a problem with stability, since the clip is mounted on a single tine. Also, a clip that is snap fit onto a single tine can be accidentally disengaged from the tine by excessive force, since there is no lateral support for the clip.

Therefore, a primary objective of the present invention is an improved clip for use on a dishwasher rack to hold objects to be washed.

Another objective of the present invention is the provision of an improved clip for a dishwasher rack wherein the clip is mounted on a pair of tines so as to provide stability and lateral support for the clip.

A further objective of the present invention is the provision of a dishwasher rack clip having a pair of upwardly extending resilient tabs each being adapted to retain an object to be washed.

A further objective of the present invention is the provision of an improved dishwasher rack clip which is quick and easy to install.

Another objective of the present invention is the provision of an improved dishwasher rack clip which is economical to manufacture and durable in use.

These and other objectives will become apparent from the following description of the invention.

SUMMARY OF THE INVENTION

The dishwasher rack clip of the present invention includes a base adapted to mount onto a pair of upstanding tines of the dishwasher rack, and a pair of resilient tabs extend upwardly from the base, with each tab being adapted to retain or restrain an article to be washed in the rack. The base includes a pair of C-shaped mounting members for receiving the tines, and a web extending between the mounting members. The tabs are S-shaped and have laterally offset upper and lower ends. The base and tabs are formed so as to have an integral construction.

DETAILED DESCRIPTION OF THE INVENTION

Figure 1:
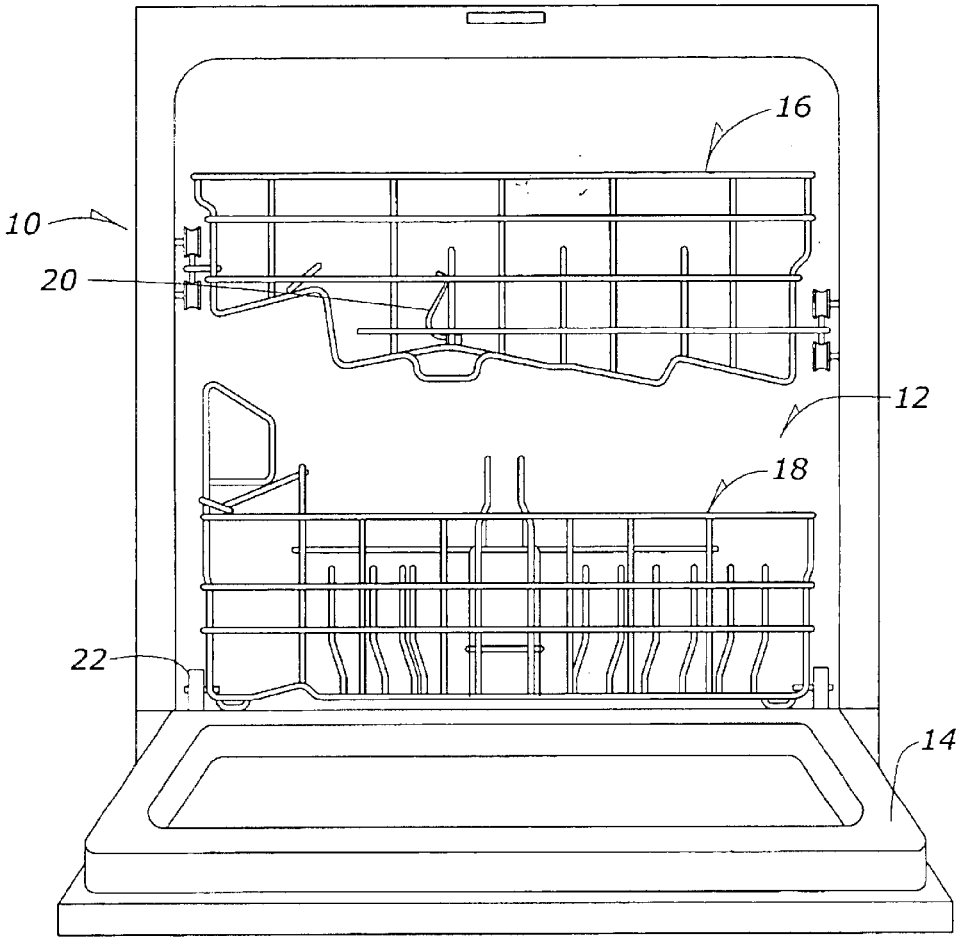
FIG. 1 is a front elevation view of a dishwasher with the door open, and having upper and lower racks, with the clips of the present invention mounted in the upper rack.
Figure 2:
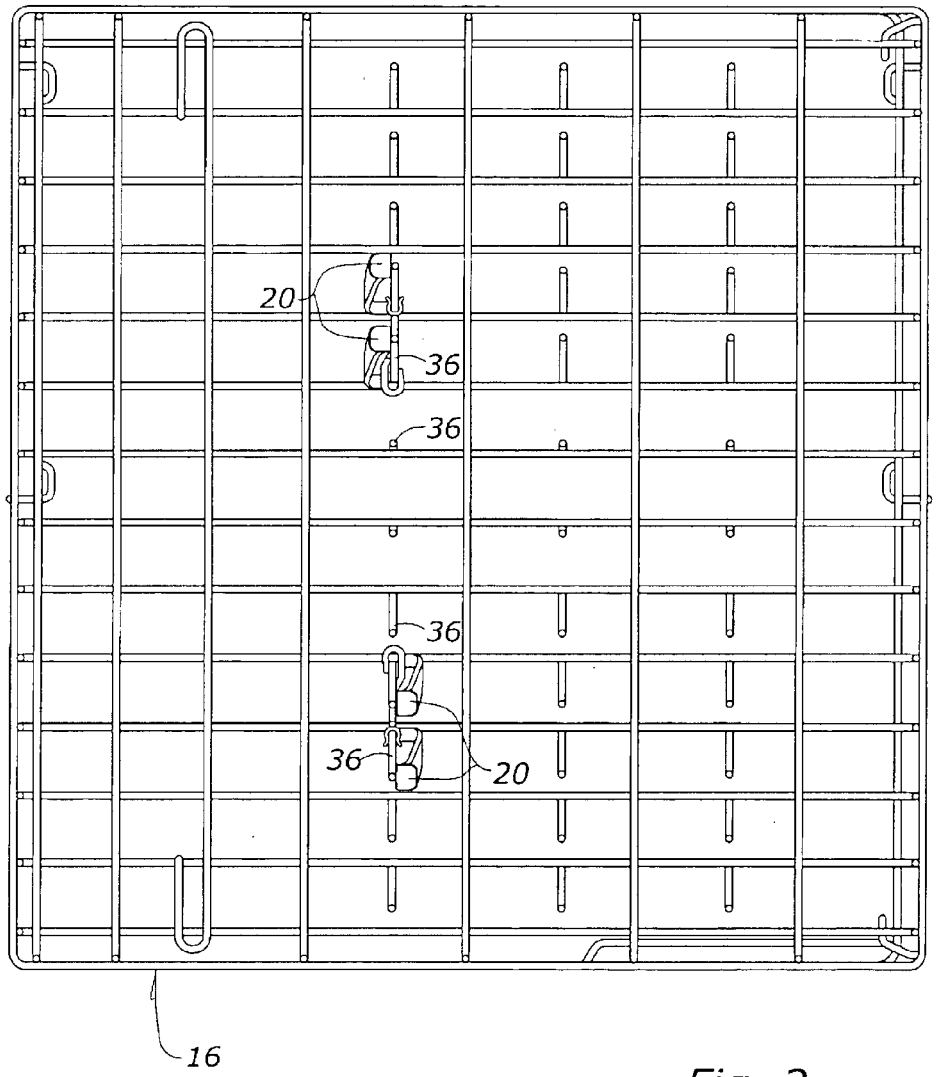
FIG. 2 is a top plan view of the upper rack of the dishwasher with the clips of the present invention mounted therein.

A dishwasher is generally designated by the reference numeral 10 in the drawings. The dishwasher 10 includes a washing chamber 12, and a door 14 movable between open and closed positions relative to the washing chamber 12. The dishwasher 10 includes an upper rack 16 and a lower rack 18 mounted in the washing chamber 12 for holding objects to be washed.

The construction of the dishwasher 10 and the racks 16, 18 is conventional, and does not constitute a part of the present invention.

The present invention is directed towards a rack clip 20, which is sometimes referred to in the industry as a cup clip. The clip 20 includes a base 22 and a pair of upwardly extending resilient tabs 24. The base 22 has a pair of mounting members 26, 27 and a web 28 extending between the mounting members 26, 27.

Figure 3:
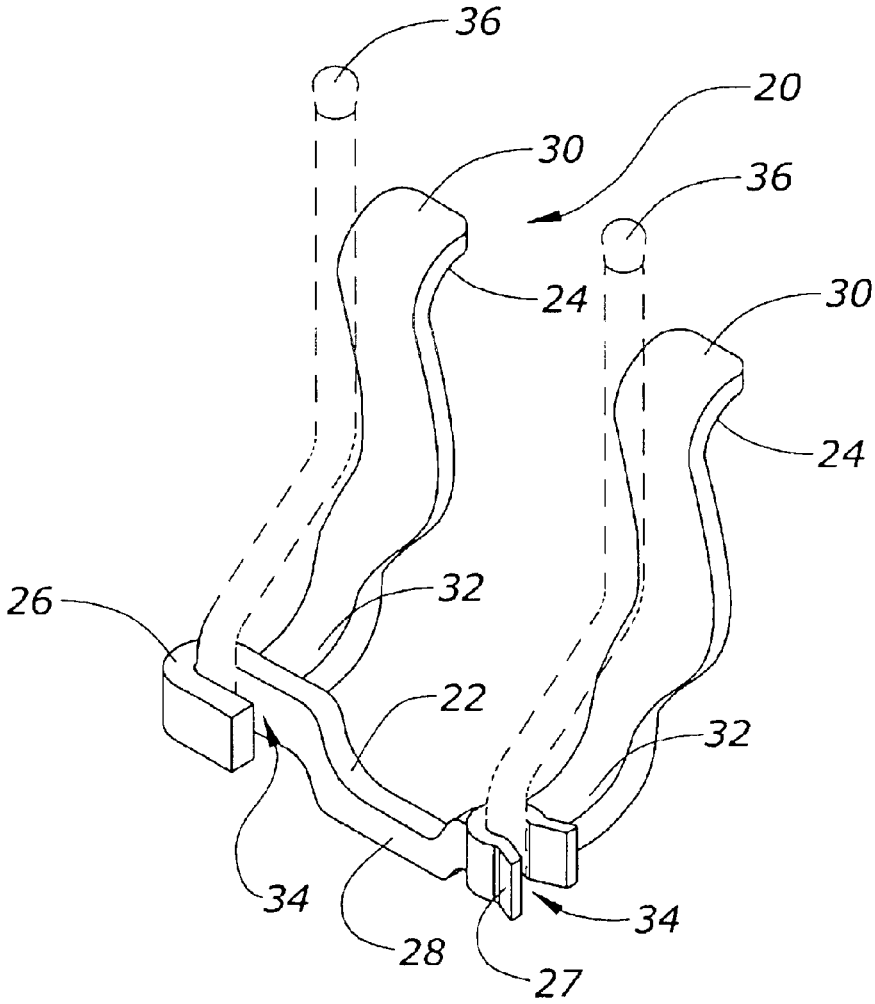
FIG. 3 is a perspective view of a first embodiment of the clip of the present invention.
Figure 4:
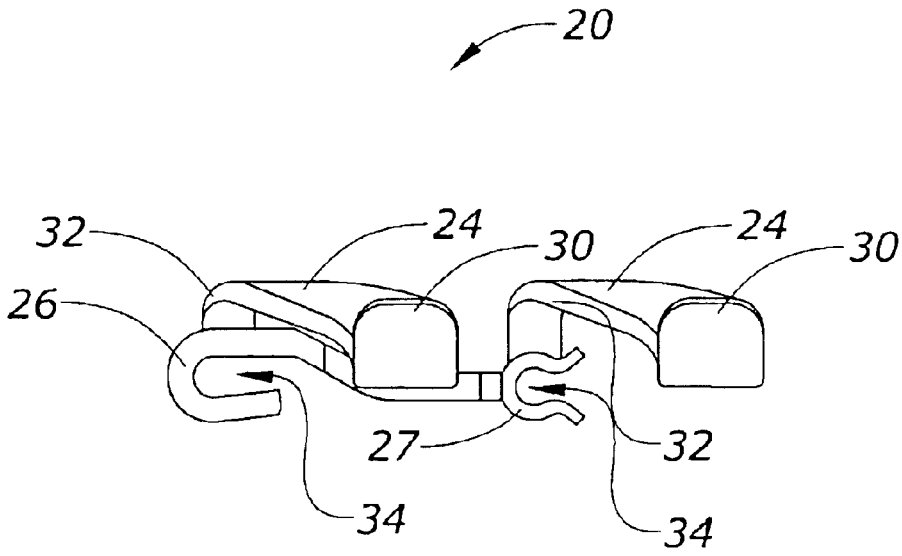
FIG. 4 is a top plan view of the clip of FIG. 3.
Figure 5:
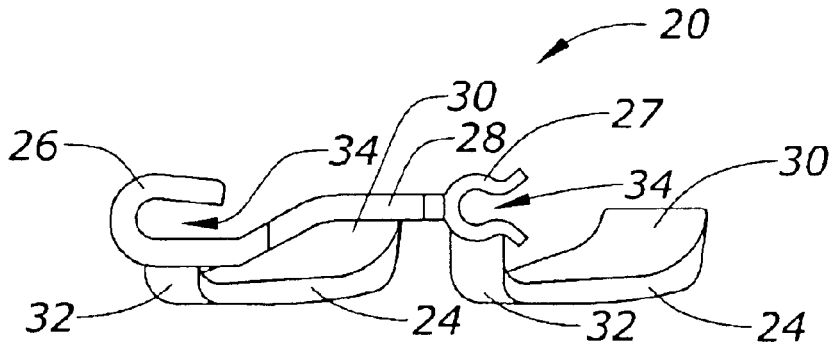
FIG. 5 is a bottom plan view of the clip of FIG. 1.
Figure 6:
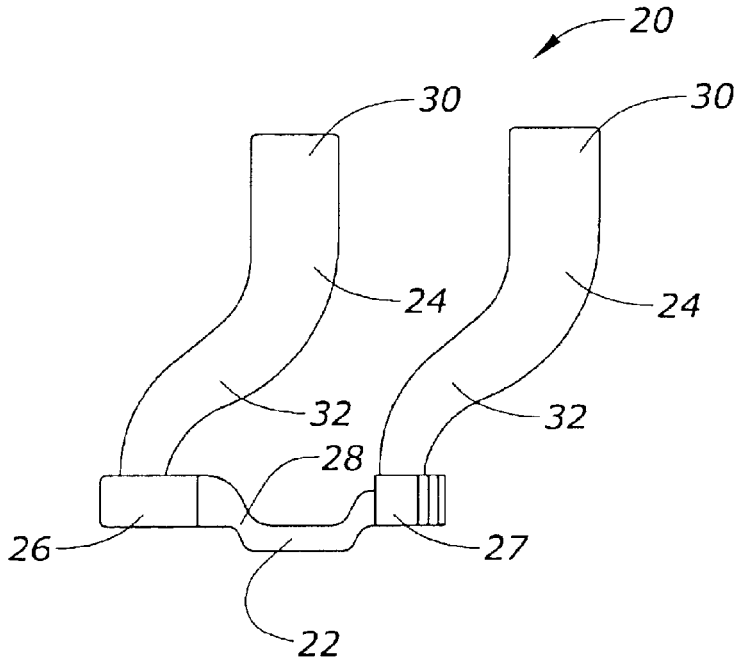
FIG. 6 is an elevation view from one side of the clip of FIG. 1.
Figure 7:
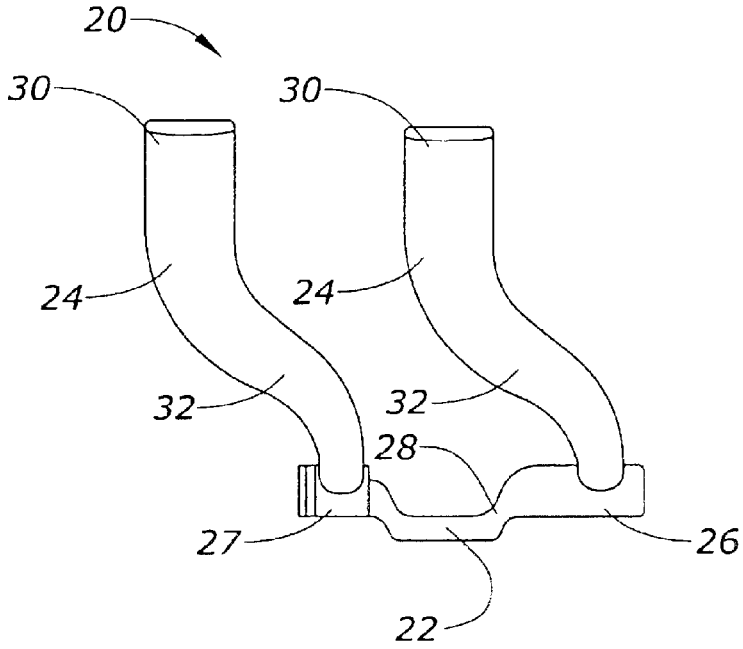
FIG. 7 is an elevation view from the opposite side of the clip of FIG. 1.
Figure 8:
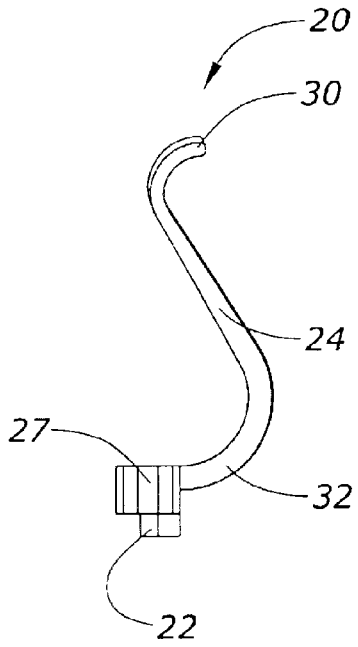
FIG. 8 is an elevation view from one end of the clip of FIG. 1.
Figure 9:
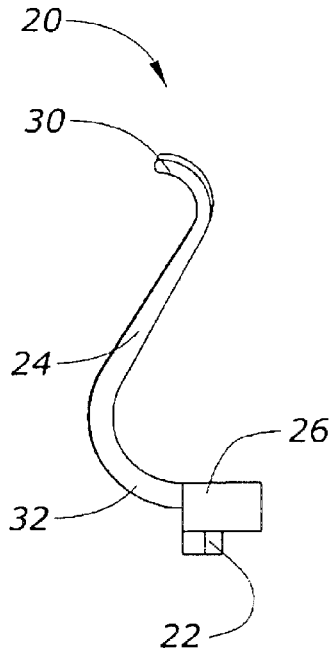
FIG. 9 is an elevation view from the opposite end of the clip of FIG. 1.
Figure 10:
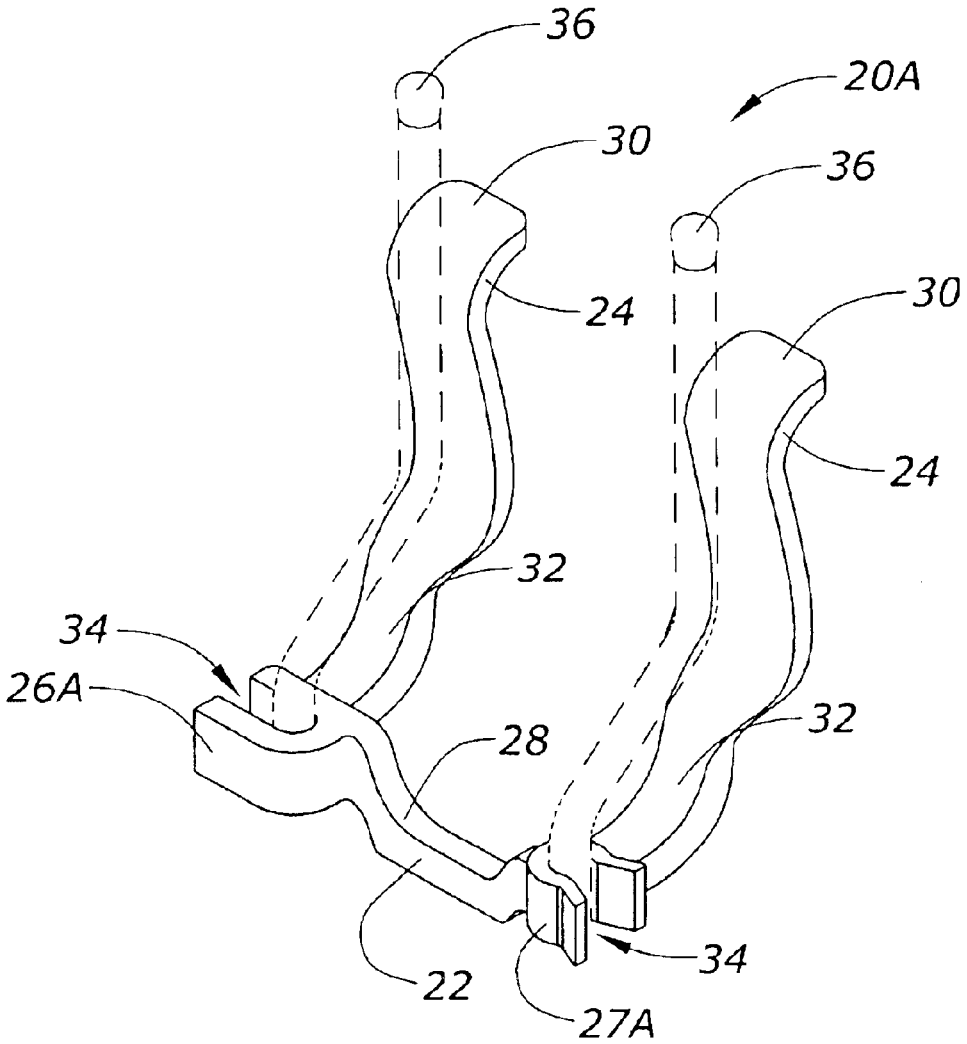
FIG. 10 is a perspective view of a second embodiment of the clip according to the present invention.
Figure 11:
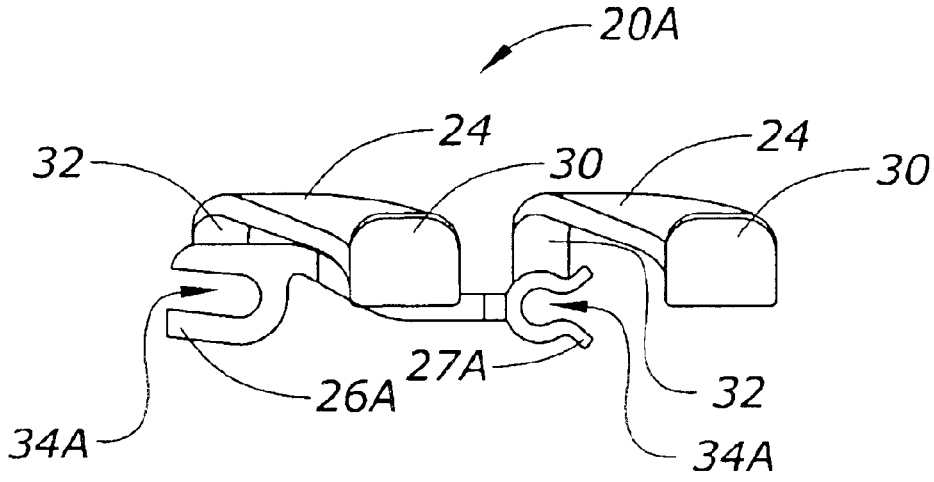
FIG. 11 is top plan view of the clip of FIG. 10.
Figure 12:
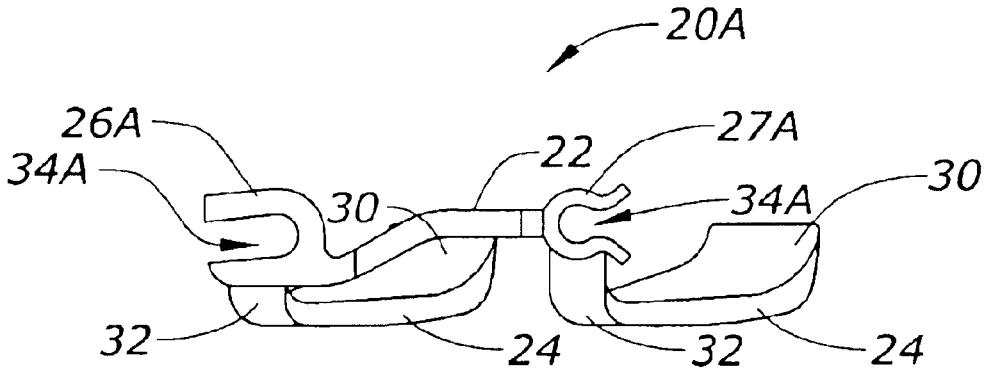
FIG. 12 is a bottom plan view of the clip of FIG. 10.
Figure 13:
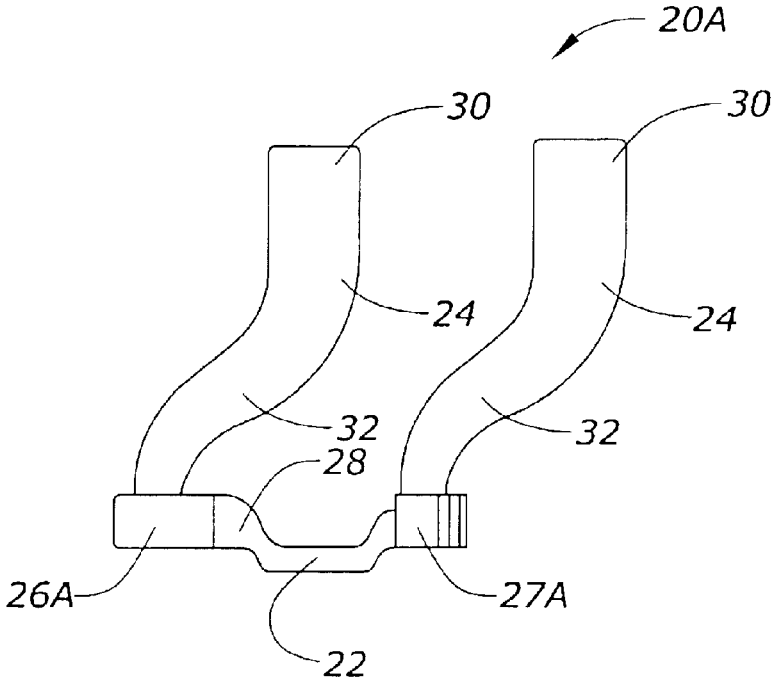
FIG. 13 is an elevation view from one side of the clip of FIG. 10.
Figure 14:
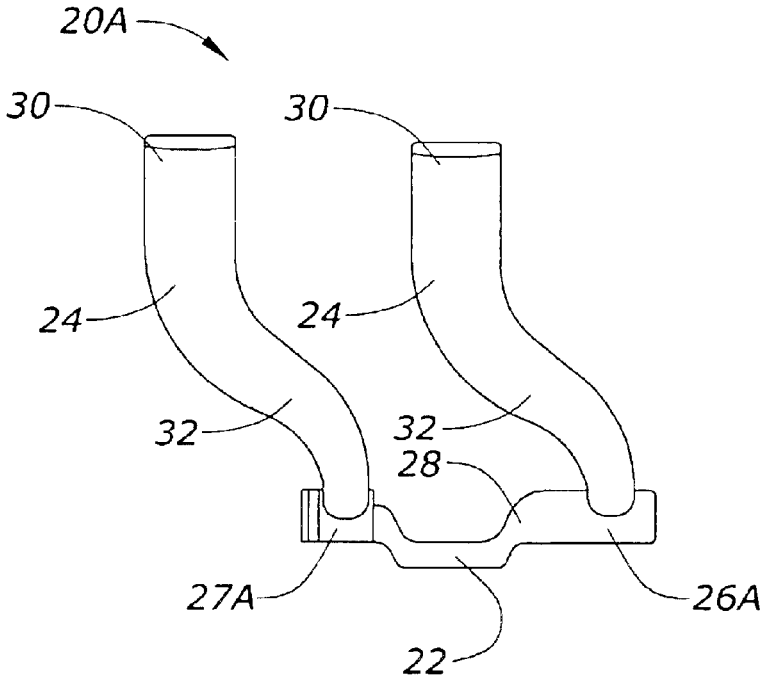
FIG. 14 is an elevation view from the opposite side of the clip of FIG. 10.
Figure 15:
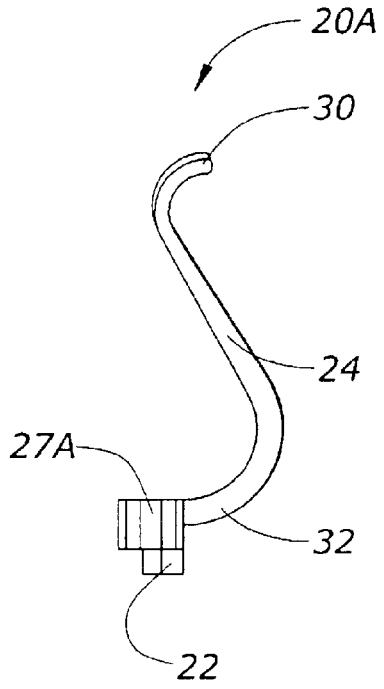
FIG. 15 is an elevation view from one end of the clip of FIG. 10.
Figure 16:
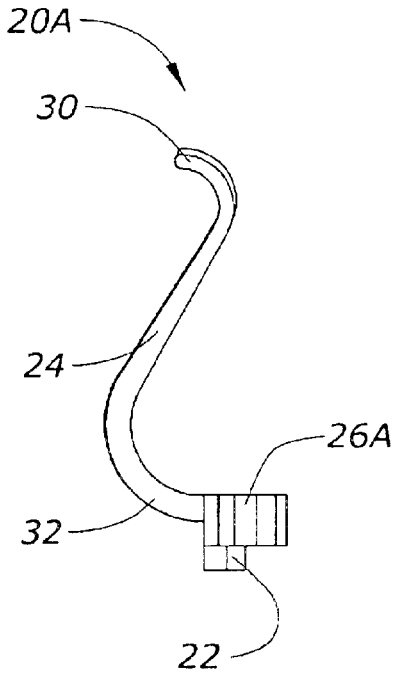
FIG. 16 is an elevation view from the opposite end of the clip of FIG. 10.

The mounting members 26, 27 define openings 34 which are adapted to retentively engage a pair of generally upwardly extending tines 36 in either of the racks 16, 18. In the preferred embodiment shown in FIGS. 3–9, the openings 34 of the mounting members 26, 27 extend in the same lateral directions. In an alternative embodiment shown in FIGS. 10–16, the openings 34A of the mounting members 26A, 27A extend in the opposite lateral direction for mounting the clip 20A to the tines 36. The mounting members 26, 26A are preferably in the form of a hook to hook around a tine 36, while the mounting member 27, 27A are C-shaped to snap fit onto a tine 36. The hook 26, 26A allows for variations in the spacing between tines 36. Mounting the clips 20, 20A to at least a pair of generally upwardly extending tines 36 enhance the lateral stability of the clips 20, 20A. The web 28 also increases the strength and stability of the clips 20, 20A.

It is understood that the mounting members 26, 27, 26A, 27A may take other forms without departing from the scope of the invention. For example, the mounting members may be an O-shaped circular ring adapted to fit over the tines 36, or hinged members to fasten around the tines. Also, both ends may be C-shaped snap fit members, similar to the mounting members 27, 27A with a flexible web 28 to allow for variation in the spacing of the tines 36. Yet another embodiment (not shown) would incorporate multiple mounting members similar to 26, 26A, 27, 27A attaching to at least three generally upwardly extending tines 36 with at least two webs 28 connecting the mounting members. This embodiment would have at least one tab 24.

The tabs 24 extend from the mounting members 26, 27, 26A, 27A. The tabs 24 generally are S-shaped to substantially match the angular profile of the tines. Thus, each of the tabs 24 has a reverse-curve profile.

In use, the clips 20, 20A can be quickly and easily mounted on a pair of tines 36 in either the upper rack 16 or the lower rack 18 of the dishwasher. An object, such as a cup or glass, can then be fit on each tab 24, such that each clip 20, 20A is adapted to retain two objects for washing. Alternatively, a single object can be located for retention between both tabs 24 and associated tines 36. The clips 20, 20A can also be quickly removed from the tines 36, if desired. Preferably, the clips 20, 20A are molded, such that the base 22 and tabs 24 are integrally formed.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A clip for holding objects in a dishwasher rack, the rack having a plurality of upstanding tines, the clip comprising:

a base having opposite ends with a laterally extending opening adjacent each end, each opening adapted to receive one of the tines so that the clip is mounted onto a pair of tines;

at least one resilient tab extends upwardly from the base, each tab adapted to engage an object for retention in the rack.

2. The clip of claim 1 wherein the tab has a curved profile.

3. The clip of claim 1 wherein the tab has a reverse-curve profile.

4. The clip of claim 1 wherein the tab is S-shaped.

5. The clip of claim 1 wherein the tab has a lower end attached to the base and an upper end laterally offset from the lower end.

6. The clip of claim 1 wherein at least one end of the base snap fits on a tine of the rack.

7. The clip of claim 1 wherein the openings face in the same direction.

8. The clip of claim 1 wherein the openings face different lateral directions from one another.

9. The clip of claim 1 wherein the base and tab have an integral construction.

10. The clip of claim 1 wherein the base and tab are molded.

11. A dishwasher rack clip comprising:

a base adapted to mount onto at least a pair of generally upwardly extending tines of a dishwasher rack;

at least one tab extending upwardly from the base and being adapted to receive an article to be washed for retention in the rack; and wherein the tab has upper and lower ends which are laterally offset from one another.

12. The clip of claim 11 wherein the base includes at least a pair of mounting members for receiving the tines and a web extending between the mounting members.

13. The clip of claim 12 wherein the mounting members face in the same direction.

14. The clip of claim 12 wherein the mounting members face in opposite lateral directions.

15. The clip of claim 12 wherein the tab extends from the mounting members.

16. The clip of claim 11 wherein the tab is S-shaped.

17. The clip of claim 11 wherein the base and tab are molded.

18. The clip of claim 11 wherein the base and tab have an integral construction.

19. The clip of claim 1 wherein each tab is adapted to cooperate with an adjacent tine so as to retain the object between the tab end the adjacent tine.

20. The clip of claim 11 wherein each tab is adapted to cooperate with an adjacent tine so as to retain the object between the tab and the adjacent tine.

21. A dishwasher rack clip comprising:

a base adapted to mount onto at least a pair of generally upwardly extending tines of a dishwasher rack;

at least one tab extending upwardly from the base and being adapted to receive an article to be washed for retention in the rack; and wherein each tab is adapted to cooperate with an adjacent tine so as to retain the object between the tab and the adjacent tine.

22. The clip of claim 21 wherein the base includes at least a pair of mounting members for receiving the tines and a web extending between the mounting members.

23. The clip of claim 22 wherein the mounting members face in the same direction.

24. The clip of claim 22 wherein the mounting members face in opposite lateral directions.

25. The clip of claim 22 wherein the tab extends from the mounting members.

26. The clip of claim 21 wherein the tab is S-shaped.

27. The clip of claim 21 wherein the tab has upper and lower ends which are laterally offset from one another.

28. The clip of claim 21 wherein the base and tab are molded.

29. The clip of claim 21 wherein the base and tab have an integral construction.

* * * * *